US006322045B1

(12) United States Patent
Andros

(10) Patent No.: US 6,322,045 B1
(45) Date of Patent: Nov. 27, 2001

(54) RAPID FORMING SYSTEM FOR TILT-UP PRE-CAST CONCRETE WALL PANELS (TILT PANEL SCREED SYSTEM-TIPSS)

(76) Inventor: Chris Andros, 1111 Bayshore Blvd. B-5, Clearwater, FL (US) 33759

( * ) Notice: Subject to any disclaimer, the term of this patent is extended or adjusted under 35 U.S.C. 154(b) by 0 days.

(21) Appl. No.: 09/126,565

(22) Filed: Jul. 30, 1998

Related U.S. Application Data

(60) Provisional application No. 60/061,409, filed on Aug. 4, 1997.

(51) Int. Cl.[7] ..... E04G 9/00

(52) U.S. Cl. ..... 249/188; 249/18; 249/189; 249/219.1; 52/127.3; 52/742.1; 52/745.2

(58) Field of Search ..... 52/745.09, 745.2, 52/730.1, 731.7, 745.1, 745.11, 293.3, 699, 731.1, 127.3, 731.9; 249/219.1, 18, 189, 188

(56) References Cited

U.S. PATENT DOCUMENTS

| | | | | |
|---|---|---|---|---|
| 428,291 | * | 5/1890 | Stuart | 52/585.1 |
| 1,179,678 | * | 4/1916 | Swift | 52/745.11 |
| 1,697,765 | * | 1/1929 | Heltzel | 52/731.7 |
| 2,350,093 | * | 5/1944 | Braloff | 52/585.1 |
| 2,940,152 | * | 6/1960 | Riehl | 52/731.7 |
| 3,017,672 | * | 1/1962 | Vaughan | 52/731.7 |
| 3,284,979 | * | 11/1966 | Edwards | 52/234 |
| 3,477,186 | * | 11/1969 | Birum, Jr. | 52/731.7 |
| 3,697,039 | * | 10/1972 | Phelps et al. | 249/219.1 |
| 3,782,680 | * | 1/1974 | Hopkins | 249/188 |
| 3,819,143 | * | 6/1974 | Butts et al. | 249/33 |
| 4,042,205 | | 8/1977 | Herrell . | |
| 4,101,111 | * | 7/1978 | Bishop | 249/205 |
| 4,104,356 | * | 8/1978 | Deutsch et al. | 264/297 |
| 4,141,532 | * | 2/1979 | Wall | 249/163 |
| 5,127,160 | | 7/1992 | Schimpff . | |
| 5,200,210 | * | 4/1993 | Schimpff | 249/219.1 |
| 5,600,930 | * | 2/1997 | Drucker | 52/585.1 |

* cited by examiner

*Primary Examiner*—Beth A. Stephan
*Assistant Examiner*—Dennis L. Dorsey
(74) *Attorney, Agent, or Firm*—Leydig, Voit & Mayer, Ltd.

(57) ABSTRACT

An apparatus and method for the rapid perimeter screed bulkhead forming of concrete tilt-up wall panels are provided. The apparatus includes a unitary formboard support, a formboard, and a fastener. The unitary formboard support includes a base, which includes a fastener passageway through the base, and two upright walls connected to the base, which form an open channel. The unitary formboard support can be attached to a casting surface or concrete floor by the fastener which passes through the fastener passageway and secures the unitary formboard support. The bottom end of the formboard is fit within the open channel of the unitary formboard support and held in position by the upright walls. Further provided is a method of casting concrete providing a unitary formboard support, fastening the unitary formboard support to a casting surface or concrete floor with a fastener that transits through the fastener passageway, providing a formboard, inserting the bottom end of a formboard within the open channel such that the formboard is held in position by the upright walls of the unitary formboard support, and pouring concrete on the exterior side of the formboard, such that the concrete is maintained in position by the unitary formboard support and the formboard.

11 Claims, 4 Drawing Sheets

RAPID FORMING SYSTEM FOR TILT-UP PRE-CAST CONCRETE WALL PANELS (TILT PANEL SCREED SYSTEM-TIPSS)

CROSS-REFERENCE TO RELATED PATENT APPLICATIONS

This patent application claims priority to U.S. Provisional Patent Application Serial No. 60/061,409, filed Aug. 4, 1997.

BACKGROUND OF THE INVENTION

When building design requires concrete walls a commonly used method for satisfying the need is concrete pre-cast wall sections. One of the popular systems available today is pre-cast concrete tilt-up wall panels. In reality the tilt-up system has been available in the U.S. for over ninety years. During this time the methods for fabrication and erection of the walls have changed little.

A concrete tilt-up wall is erected as the name implies. The wall section is first cast horizontally on some firm flat surface, usually the concrete floor of the building it is intended to support. In order that the concrete panel not adhere to the concrete floor, or surface supporting it, a commercially available chemical coating is first applied to the surface as a bond breaker. After the concrete has hardened to strength a heavy capacity lifting crane is employed to lift, or tilt, the wall section to a vertical position. The wall panel is set upon a concrete foundation or footing at which point it is temporarily supported until permanently incorporated into the structure it serves. The overall technique for casting and lifting is so basic little has changed in the methodology of tilt-panel work over decades.

One of the most labor-intensive portions of tilt-up panel construction is the forming and casting of the panel itself. After the casting surface, or floor, is available for panel forming, the crew lays out the shape of the tilt-up wall panel and proceeds to construct a perimeter bulkhead or screed system conforming to that layout. The method of fastening the bulkhead to the forming surface is by concrete nailing, or self-tapping screws set into pre-drilled holes. This bulkhead or screed is of a height that equals the thickness of the wall panel to be cast. Currently, and historically, the lumber and materials that are used to create this screed system are of dimensions for lumber and other common elements readily available on the commercial market. This by its nature makes forming dimensions a conform to 2×lumber width and thickness. The result is most tilt panels are as thick as the dimensions of the lumber. This generally limits engineering design to those wall thicknesses.

Further, when laying out the walls the normal vertical wall joint spacing when erected, usually ½" to 1", must be allowed for. This is because the bulkheads are made from 2×6, 8 or 12 inch lumber floor plates and vertical 2×6, 8 or 10/12 wood bulkheads all resulting in the cross section shape of an "L". This leads to calculating and adjusting allowance for various layout dimensions. The thickness dimension of the wall may be altered by adding to the bulkhead height in some fashion, all at additional cost.

A negative and costly feature of this generic method is that the forming materials often become expendable because of cutting, rough use and destruction during dismantlement of the formwork. Another poor feature of this system is that during construction and removal of the materials, using the current technique, damage is inflicted on the floor requiring extensive remedial patching and correction. In view of these and other limitations, there is a need for alternative methods and apparatuses that can address the limitations associated with the techniques currently practiced in the art. The invention provides such methods and apparatuses. These and other advantages of the present invention, as well as additional inventive features, will be apparent from the description of the invention provided herein.

BRIEF SUMMARY OF THE INVENTION

The present invention provides a device and method for the rapid perimeter screed bulkhead forming of concrete tilt-up wall panels, using an apparatus comprising a unitary formboard support, a formboard, and a fastener. The unitary formboard support of the present invention is a device having a shape that will retain a formboard (e.g., a standard thickness plywood formboard) inserted into an open channel formed by upright wall components of the unitary formboard support so that the formboard is supported in a vertical position.

The unitary formboard support of the invention is fastened to the concrete floor, normally used as a casting bed, by means of concrete nails, or self-tapping screws designed for use in concrete. When the unitary formboard support of the invention is dropped edgewise between the vertical upright walls of the invention, the vertical upright walls grip the formboard in place by gravity and friction.

Once this forming system is set, the tilt panel lifting devices, steel hardware, special cast-in material and reinforcing steel that are to be fixed into the concrete are placed. The concrete is poured within the forming system, formed by the unitary formboard support of the invention, and allowed to cure. Upon the concrete wall panel section being erected the formboard (e.g., the plywood forming material) is lifted out from the unitary formboard support of the invention and the unitary formboard support of the invention is removed from the floor forming surface by removing the nails or screws.

DETAILED DESCRIPTION OF THE INVENTION

Figure 1:
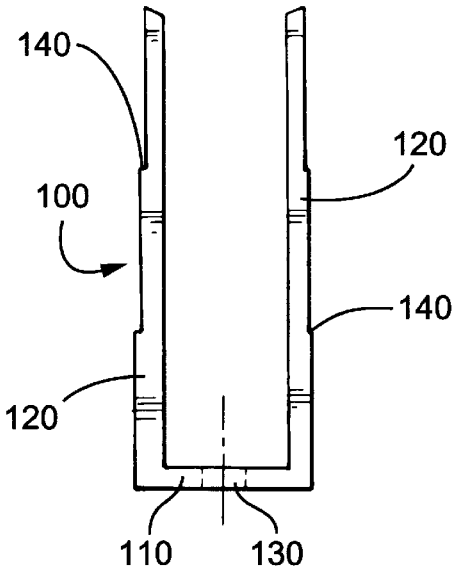
FIG. 1 is a cross sectional view of a first embodiment of the unitary formboard support component of the invention.

The unitary formboard support of the present invention has a shape that allows the unitary formboard support to hold a formboard (i.e., a standard thickness plywood formboard or similar device composed of similar dimensional material)

inserted into it so that the formboard is supported in a vertical position when the unitary formboard support is placed with the flat bottom closed end of the channel. The unitary formboard support of the invention is given this shape by two upright walls facing perpendicular to the floor and the base of the support and thereby forming an open (U-shaped) channel that faces upwards.

The unitary formboard support of the invention can be manufactured from any material commonly available for rigid fabrication of construction apparatus, such as extruded aluminum, steel or various grades and types of extruded plastic. The unitary formboard support of the invention can be fabricated by extrusion, in the embodiments where the unitary formboard support is composed of plastic and/or aluminum, or metal working, such as rolling and stamping, in embodiments where the unitary formboard support is composed of steel or aluminum. The unitary formboard support of the invention can be produced in any suitably manageable length, typically ranging up to twenty feet in length.

The unitary formboard support is set (rested) on the casting surface or floor with the bottom closed end face of the open channel resting on the casting surface or floor, the upright walls facing perpendicular to the floor and thereby forming an open channel that faces upwards. The unitary formboard support is then properly positioned on previously established outlines of the tilt-up wall panel planiform to be cast. Once positioned, the unitary formboard support of the invention is fastened to the casting surface or concrete floor. The unitary formboard support can be affixed by any mechanical means that will allow a fastener to be inserted between the upright walls of the device. Typically, the unitary formboard support of the invention is affixed to the casting surface by means of concrete nails, or self-tapping screws designed for use in concrete. Preferably, the unitary formboard support of the invention is affixed to the casting surface by self-tapping concrete screws inserted through the fastener passageway which includes one or more holes formed in (e.g., drilled into) the base of the unitary formboard support.

A minimum of fasteners between the casting surface and the unitary formboard support of the invention are required in the context of the present invention because of the long and manageable lengths of the unitary formboard support(s) described herein. Thus, the present invention provides embodiments wherein the unitary formboard support of the invention is made in a length requiring few fasteners to hold the unitary formboard support in place. Such embodiments are often desirable because by using less fasteners damage to the casting surface, or concrete floor, as applicable, is minimized.

When the unitary formboard support of the invention is in the proper position, having been affixed to a concrete floor or a casting surface, the formboard is dropped edgewise into the open channel of the unitary formboard support, until it reaches the bottom of the open channel, which is formed by the upright walls. Once held upright, the formboard forms a low bulkhead equal to the desired form and thickness of the concrete wall panel. The formboard is held in place by gravity friction created at the vertical walls of the invention. No further fastening of any sort is required.

Thus, the present invention provides rapid forming of a wall panel by one step use of a supporting device that can hold a formboard. Furthermore, the invention provides the ability to use a formboard of any desired width thus creating tilt-up wall thickness with an infinite variation of dimension. Thus, by using the present invention the designer is not limited to dimensions of commercially available formboards, such as 2×lumber.

Once this forming system is set, tilt panel lifting devices, steel hardware, special cast-in material and reinforcing steel that are to be fixed into the concrete panel are placed. The concrete is poured within the forming system and allowed to cure. At the time the concrete is hardened, the tilt-up wall panel is lifted into place.

Once the concrete has been placed within the forms produced by the positioning of one or more of the apparatuses of the invention, and cured to a hardened state, the formboard(s) may be removed. The removal of the formboard(s) is accomplished by gripping one end of the formboard and lifting it out of the unitary formboard support. After the concrete wall panel is raised up from the casting surface, the unitary formboard support can be removed by the quick removal of the fastener(s) (e.g., the nails or screws) used to hold the unitary formboard support in place. Thus, after the formboard has been removed, the fastener(s) are removed from the fastener passageway and the unitary formboard support is ready for re-use. Optionally, the entire apparatus can be dismantled and removed as described herein after wall panel lifting has taken place.

In some embodiments, the invention provides unitary formboard supports having elevation indicators on the unitary formboard support that allow the designer to determine elevation once the unitary formboard support has been affixed to the casting surface. Suitable indicators on the unitary formboard support for identifying elevations are protuberances, or horizontal lines, that are positioned along the length of the exterior of the upright walls. The various elevations determined by the casting level lines, permit casting to various levels a plate, or wythe, of concrete in the panel in preparation for creating wall panels with several wythes or plys.

Another feature of the present invention is the ability to incorporate various shapes (shaping extensions) at the base or corners of the open channel. Often, the edge of the wall panel requires a shape that is chamfered or some similar section. The primary purpose of the shaping extension is to prevent the chipping of the concrete wall corners during handling thus preventing an unsightly product. Additionally, the inclusion of shaping extensions permits neatness, cosmetic attraction and extra surface area for caulking materials to grip and remain secure from external abuse.

The present invention provides an apparatus and device for producing such chamfered or similarly sectioned walls. Specifically, in such embodiments, a shape is imparted to the exposed edge of the pre-cast panels by using an extension of the material of the unitary formboard support, at its base, for an incorporated shape. This shaping extension, is placed at the base of the device and on the same plane as the bottom face. The shape to be imparted creates a direct and opposite reflection of the shaping extension on the surface of the concrete panel it comes into contact with. The shape of the shaping extension can take the form of 45° angle chamfers, ¼ round corners, or other suitable shapes.

The present invention provides embodiments allowing casting tilt panel walls wherein the incorporation of the joint width of the vertical walls occurs automatically during layout, because the width of the formboard is essentially equal to the joint width. More particularly, in such embodiments, the dimension between the upright walls is specifically selected so that the supported formwork (the several formboards), held upright in the upright walls, is equal to the design dimension for the parting joints in the vertically erected tilt panel walls. Preferably, this joint forming capacity of the present invention is initially incorporated into the formboard and unitary formboard support selected when the formboard is constructed on the casting surface. Thus, in such embodiments, a unitary formboard support having a width between the upright walls, which when combined with the formboard's dimensions, are specifically dimensioned to the joint width of the tilt panel produced by such embodiments.

This joint spacing formed by such embodiments of the invention serves several purposes, primary of which is the allowing of space to insert a soft backer filler rod and caulking to weather seal the walls. The joint spacing also allows for small variations in leveling and erection of the wall panels. Furthermore, the joint created by the formboard creates a common form which allows casting of entire wall lengths in segments on the available casting surface as the building walls would be in their true overall vertical dimension.

The present invention also provides another method for the rapid layout of several associated wall sections with a very minimum of layout work and dimensioning. This is done by dimensioning from wall panel joint center to center directly from the design plans. Once the top and bottom perimeter lines representing the top and bottom of the concrete wall panels have been established, the wall panel width is laid out from center to center. The worker then proceeds on to building the remaining formwork.

A desirable feature of the present invention is the ability to cast many panels simultaneously side by side in particular embodiments. In such embodiments, several apparatuses of the present invention (including unitary formboard support and formboard), are set end to end to form a rapidly built enclosure, and create a wall panel of any desired size. The mating, or butting, edges are held firmly from lateral displacement at the joint of the apparatuses by the formwork spanning the joint created between the apparatuses.

The casting of multiple side-by-side panels can also be accomplished by using the bulkhead, formed by positioning multiple formboards, held by the unitary formboard supports, in contact with each other, as a common screed form or barrier. This ability to use a common form allows great lengths of wall segments to be laid out on the horizontal plane as they appear when erected vertically in place. Thus, the present invention provides the ability to create an entire vertical wall line at one time with no lost floor or casting area. This is especially important when temporary casting surfaces must be created at great cost per unit of area.

The present invention can also be effectively employed to create mitered corners in corner abutting wall panels at the vertical joint by placing the base on one longitudinal edge and then rotating the base to any degree. When the device is placed and supported in such embodiments, the formboard is inserted into the device at the established rotation and thus the entire assembly creates the side form required to make a desired bevel/miter shape.

The present invention provides several additional advantages in addition to those listed above. For example, the present invention is the ability to horizontally lay out the walls with the same dimensions as the design plans depict for the wall panels in the vertical plane. There is no calculation or re-dimensioning of the layout on the casting surface to allow for various dimensions of the form thicknesses. Another advantage attendant the present invention is the almost total recovery of materials used in the process and available for reuse many times. Overall, the invention provides a unitary formboard support that, in combination with a formboard held therein, is useful for forming support of the perimeter formboards used in concrete casting of tilt panel concrete walls. The system provided by the invention is less expensive and much faster than existing methods the present invention provides a means for building a concrete tilt up wall panel rapidly and in a much less labor-intensive fashion.

For purposes of further understanding of the invention, reference will now be made to the apparatus as shown in the figures and specific language will be used to describe the same. It will nevertheless be understood that no limitation of the scope of the invention is thereby intended, and that the apparatus shown therein represents only some of the features of the claimed invention.

FIG. 1 provides a cross sectional view of a first embodiment of the unitary formboard support component of the invention. The unitary formboard support 100, comprises a flat horizontal base 110, and two upright walls 120. The base 110 comprises the fastener passageway 130, through which a fastener, such as a concrete self tapping screw is inserted to retain the unitary formboard support 110 in position. Along the exterior of the upright walls 120, elevation indicators 140, consisting of two notched steps per side, are positioned. When concrete is poured and maintained in position by such an apparatus, the level of concrete poured can be held at a pre-determined elevation for various purposes. Alternatively, the concrete can be poured to the top of the formboard 540 as shown in FIG. 5.

Figure 2:
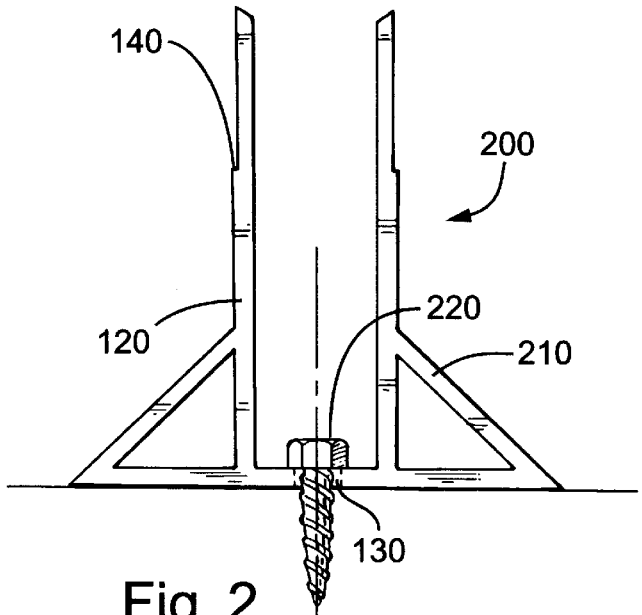
FIG. 2 is a cross sectional view of an alternate unitary formboard support component of the invention.

FIG. 2 shows a cross sectional view of an alternate unitary formboard support component of the invention. As with the first embodiment, the unitary formboard support 200 in this embodiment comprises two upright walls 120 having elevation indicators 140. The difference (besides less elevation indicators) is that the unitary formboard support 200 in this embodiment comprises shaping extensions 210 that enable the designer to produce chamfered concrete tilt-up walls as described herein. A fastener 220, more particularly a self tapping screw, transits through the fastener passageway 130 in the base of the unitary formboard support.

Figure 3:
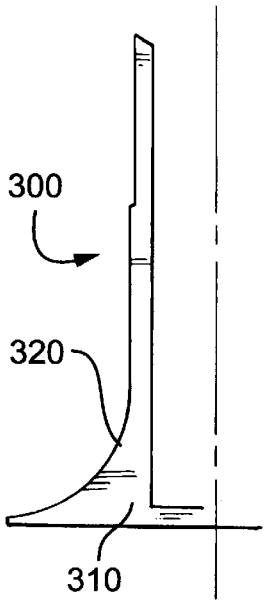
FIG. 3 is a cross sectional view of alternate base of the invention.
Figure 4:
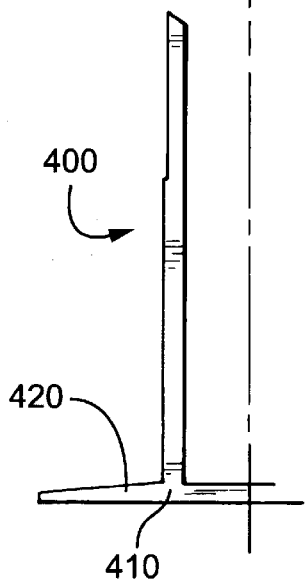
FIG. 4 is a cross sectional view of alternate base of the invention.

The base of the present invention can be a straight base as shown in FIG. 1 and FIG. 2 or can consist of an alternate style base as shown in FIG. 3 and FIG. 4. Specifically, the unitary formboard support 300 shown in FIG. 3 comprises a base 310 having sloping base supports, which support the base and which also allow the unitary partition support 300 to produce smooth chamfered tilt up walls as described herein. Alternatively, the present invention provides as shown in FIG. 4, a unitary formboard support 400 comprising a base 410 having an extended base support 420, without sloping between the exterior of the upright wall and base support 420.

Figure 5:
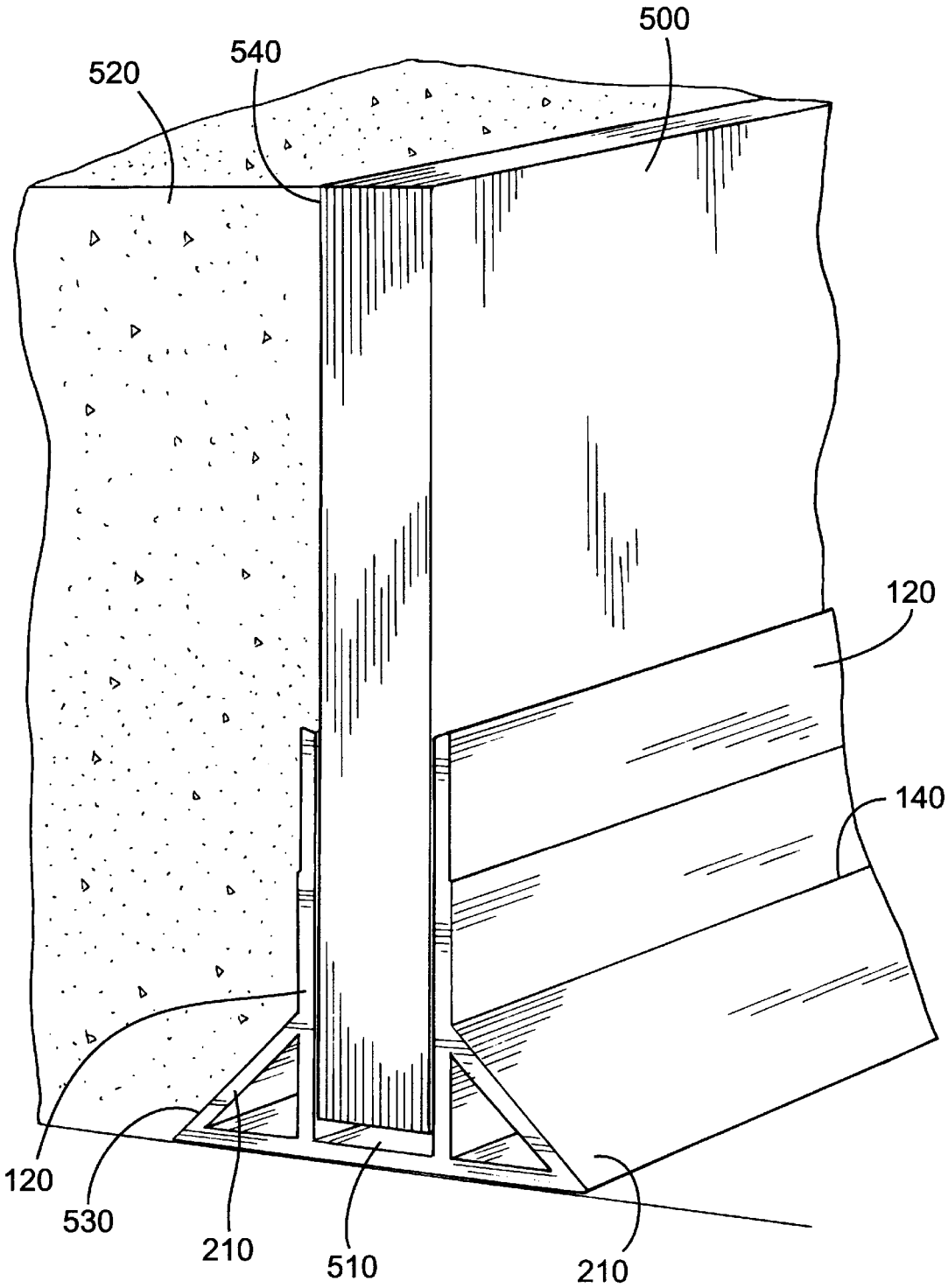
FIG. 5 is a perspective view of an apparatus of the present invention, as used to cast concrete.

The assembled apparatus of the present invention is used to cast concrete, as shown, for example, in FIG. 5. A formboard 500, such as a plywood formboard, is inserted into the open channel 510, formed between the upright walls 120. The concrete 520 is poured adjacent to the exterior end of the formboard 500. In the embodiment shown in FIG. 5, shaping extensions 210 allow the formation of a chamfered concrete wall panel at the point 530 where the poured concrete contacts the shaping extension 210.

Figure 6:
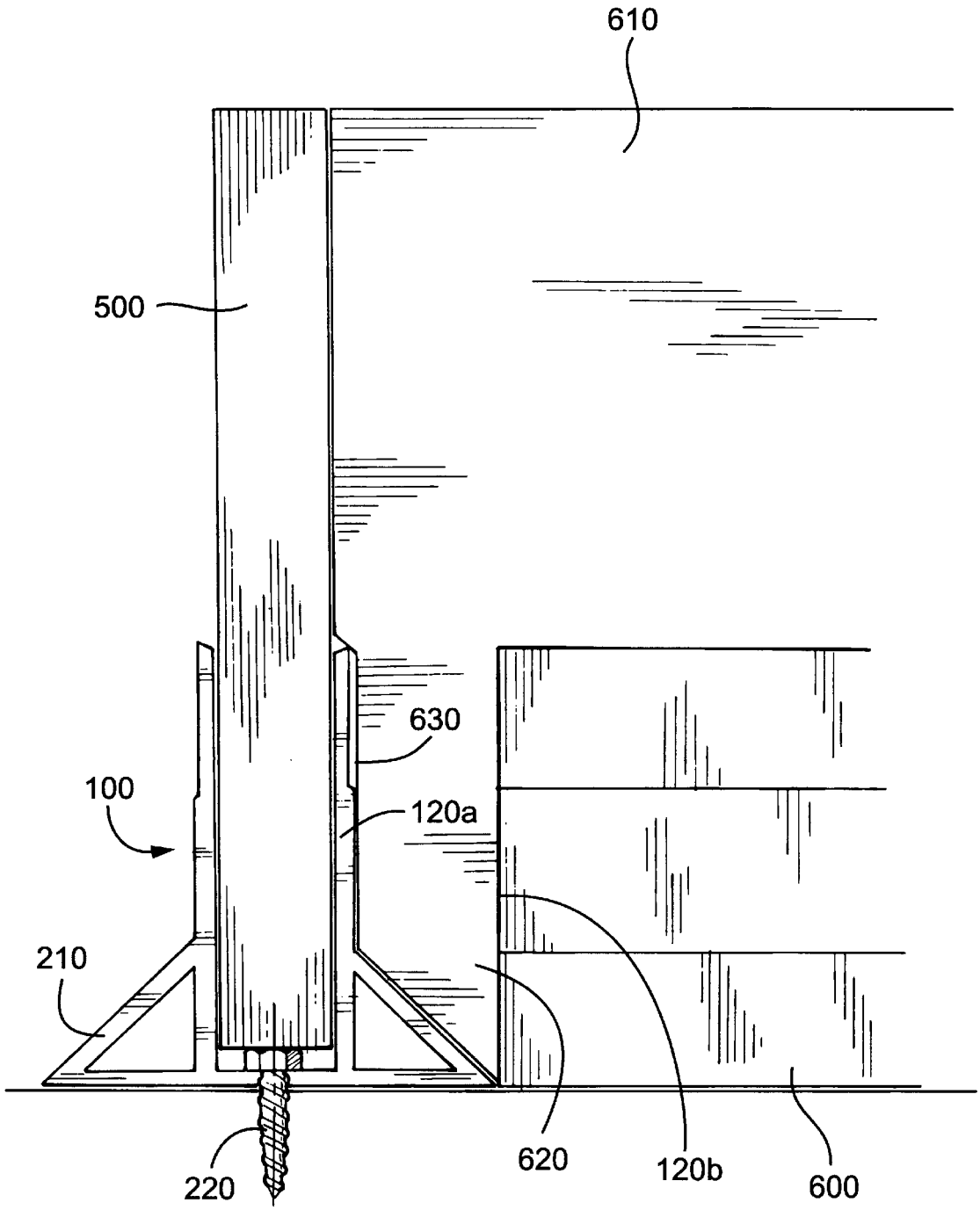
FIG. 6 is a perspective view of an intersection of two of the apparatuses of the present invention, used in particular embodiments of the invention.
Figure 7:
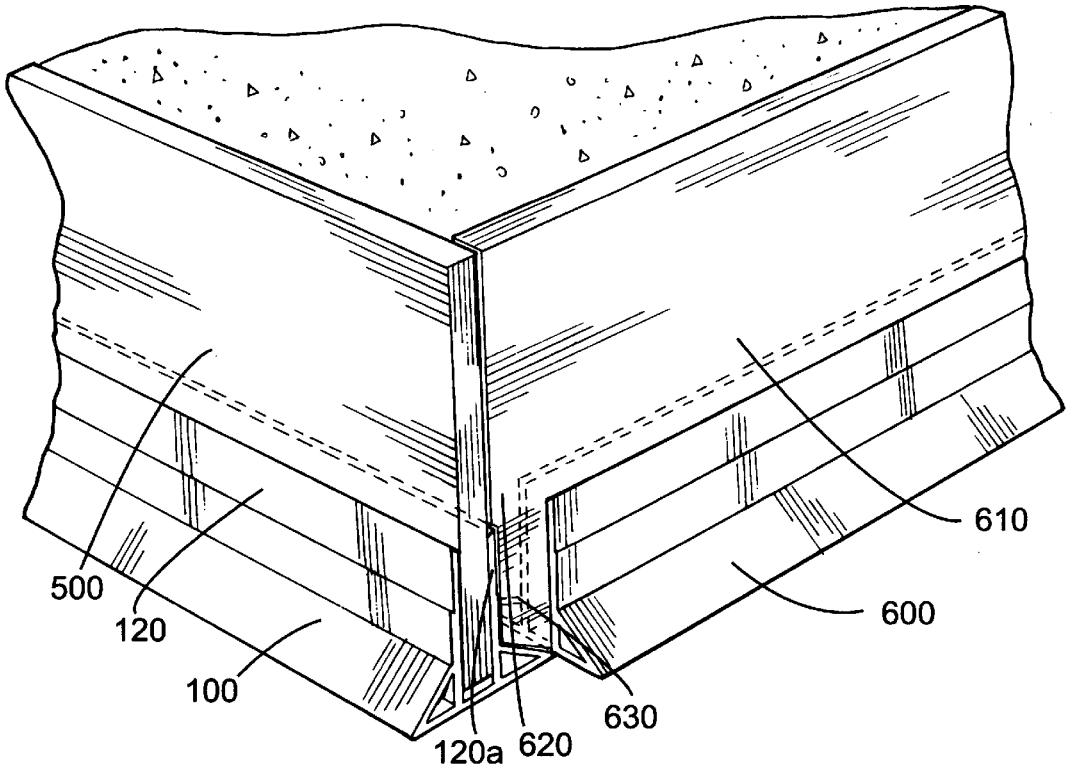
FIG. 7 is an alternate perspective view of the apparatus configuration shown in FIG. 6.

The present invention provides the rapid casting of concrete tilt-up panels by using the apparatuses and methods described herein in concert. FIGS. 6 and 7 depict the invention as utilized in creating intersections, in a manner such that a complete enclosure can be constructed for the containment of the concrete. Specifically, the present invention provides a first unitary formboard support 100 in which a first formboard 500 is maintained in position between the unitary formboard support's upright walls 120 as described herein. A second unitary formboard support 600 which is positioned so as to intersect (about perpendicular) to the direction of the first unitary formboard support 100 also maintains a second formboard 610. The second formboard 610 is allowed to extend beyond the end of the second unitary formboard support 600 into a non-bound region 620 that includes a contacting face 630 that engages one upright wall 120*a* of the first unitary formboard support. To facilitate a complete seal, the contacting face 630 of the second formboard 610 is trimmed to the shape of the exterior edge surface of the upright wall 120*b* of the first unitary formboard support that the second formboard contacts, thereby forming a sealing juncture as described herein. Thus, the first and second unitary formboard supports and formboards acting in concert as described form a corner-like form that allows the rapid formation of a concrete wall.

Figure 8:
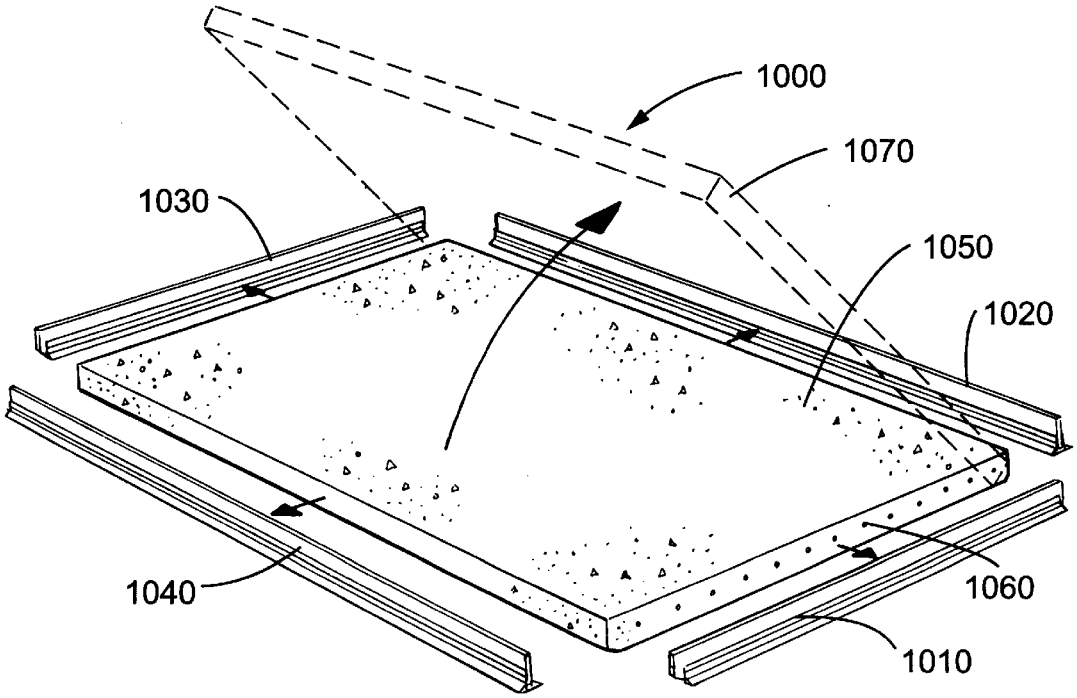
FIG. 8 is an exploded view of a casting assembly comprising four of the apparatuses of the present invention, and demonstrating the production of a tilt-up panel using the inventive apparatuses and methods.

The apparatuses of the invention can be combined as described above to form concrete casting forms. For example, as shown in FIG. 8, four unitary formboard supports (1000, 1010, 1020, and 1030), each holding a unitary formboard by its upright walls, are assembled in a rectangular formation to provide a casting form 1000. Accordingly, the concrete 1050, which may include lifting devices 1060 (as mentioned above), forms a rectangular panel which can be tilted upward (1070) for use in constructing a building.

What is claimed is:

1. An apparatus for use in casting concrete comprising a unitary formboard support, said unitary formboard support comprising:

(i) a base, (ii) two upright walls connected to sad base, said upright walls forming an open channel in conjunction with said base suitable for holding a formboard, and (iii) at least one elevation indicator, wherein sad unitary formboard support is suitable for use in the preparing of forms for retaining concrete during concrete casting.

2. The apparatus of claim 1, wherein said unitary formboard support further comprises at least one shaping extension.

3. The apparatus of claim 2, wherein said shaping extensions are in the form of 45° angle chamfers or ¼ round corners.

4. The apparatus of claim 1, wherein said apparatus further comprises a formboard formed of a material suitable for retaining concrete, wherein said formboard is fit within said open channel.

5. The apparatus of claim 4, wherein the formboard is in direct contact with and held in position by said unitary formboard support without further fastening.

6. The apparatus of claim 1, wherein said base of said unitary formboard support includes a fastener passageway through said base, and wherein said apparatus further comprises a fastener capable of fastening said unitary formboard support to a casting surface using said fastener passageway.

7. The apparatus of claim 6, wherein said fastener is a unitary fastener.

8. The apparatus of claim 7, wherein said unitary fastener is a concrete nail or self-tapping screw.

9. A method for forming a concrete case comprising:

(i) arranging at one or more predetermined locations a unitary formboard support comprising:

(A) a base, said base including at least one fastener passageway through the base, (B) two upright walls extending from said base and forming an open channel in conjunction with said base, and (C) at least one elevation indicator, (ii) fastening said unitary formboard support to a casting surface or concrete floor with a fastener using said fastener passageway;

(iii) inserting a form board into said open channel, and (iv) pouring concrete to a level equal to a preselected one of said elevation indicators such that the concrete is maintained in position by sad unitary formboard support and said formboard thereby forming a concrete cast.

10. A method for forming a concrete case comprising:

(i) arranging at one or more predetermined locations a unitary formboard support comprising.

(A) a base, said base including at least one fastener passageway through the base, and (B) two upright walls connected with and substantially perpendicular to said base, said upright walls forming an open channel in conjunction with said base suitable for holding a formboard, wherein said base does not extend beyond the exterior of said upright walls, (ii) fastening said unitary formboard support to a casting surface or concrete floor with a fastener using said fastener passageway;

(iii) inserting a formboard into said open channel, wherein said formboard is in direct contact with and held in position by said upright walls of said unitary formboard support without further fastening of said formboard to said unitary formboard support, and (iv) pouring concrete to a preselected level such that said concrete is maintained in position by said unitary formboard support and said formboard thereby forming a concrete cast.

11. A method for forming a concrete case comprising:

(i) arranging at one or more predetermined locations a unitary formboard support comprising:

(A) a base, said base including at least one fastener passageway through the base, (B) two upright walls connected to said base, said upright walls forming an open channel in conjunction with said base suitable for holding a formboard, and (C) at least two shaping extensions positioned on opposite sides of said open channel, (ii) fastening said unitary formboard support to a casting surface or concrete floor with a fastener using said fastener passageway;

(iii) inserting a formboard into said open channel, wherein said formboard is in direct contact with and held in position by said upright walls of said unitary formboard support without further fastening of said formboard to said unitary formboard support, and (iv) pouring concrete to a preselected level on at least one side of said open channel such that said concrete is maintained in position by said unitary formboard support and said formboard thereby forming a concrete cast shaped in part by contact with said shaping extension.

* * * * *